US005897467A

United States Patent [19]

Habing et al.

[11] Patent Number: 5,897,467

[45] Date of Patent: Apr. 27, 1999

[54] ARTICULATED UPPER ARM EXERCISER

[75] Inventors: Theodore G. Habing, Santa Ana; Yong S. Chu, Glendale, both of Calif.

[73] Assignee: Precor Incorporated, Bothell, Wash.

[21] Appl. No.: 08/865,475

[22] Filed: May 29, 1997

[51] Int. Cl.[6] ..... A63B 21/00; A63B 23/12

[52] U.S. Cl. ..... 482/100; 482/139; 482/142

[58] Field of Search ..... 482/52, 72, 97, 482/99, 100, 133, 136–138, 139, 142

[56] References Cited

U.S. PATENT DOCUMENTS

| | | | |
|---|---|---|---|
| 4,387,893 | 6/1983 | Baldwin . | |
| 4,411,424 | 10/1983 | Barnett | 482/100 X |
| 4,511,137 | 4/1985 | Jones | 482/100 |
| 5,094,449 | 3/1992 | Stearns . | |
| 5,106,081 | 4/1992 | Webb | 482/137 |
| 5,183,448 | 2/1993 | Wang | 482/52 |
| 5,344,374 | 9/1994 | Telle . | |
| 5,437,589 | 8/1995 | Habing | 482/72 |
| 5,484,365 | 1/1996 | Jones et al. | 482/100 X |
| 5,486,150 | 1/1996 | Randolph | 482/133 |
| 5,582,564 | 12/1996 | Nichols, Sr. et al. | 482/97 |

FOREIGN PATENT DOCUMENTS 2223686 10/1989 United Kingdom .

*Primary Examiner*—John Mulcahy

*Attorney, Agent, or Firm*—Blakely, Sokoloff, Taylor & Zafman LLP

[57] ABSTRACT

An exercise machine has a pair of exercise mechanisms pivotally coupled to the frame of the machine for use by an operator in performing a biceps curl exercise. Each such mechanism includes an exercise arm coupled to the frame for rotation about two spaced-apart, generally horizontal axes. One axis is fixed with respect to the frame, while the second axis is rotates about the first axis. A linkage member pivotally coupled to both the frame and the exercise arm connects the two axes of rotation. An additional linkage member is connected between the exercise arm and the frame. Exercise resistance is provided by weights, although other sources of exercise resistance may be used. As the operator applies an exercise force to the exercise arms, the arms rotate about both the first and second axes, the relative movement about the two axes being coordinated by the linkage members. This method can also be applied to many other types of exercise machines involving a non-linear motion path, including, for example, machines for performing triceps, leg curl, and leg extension exercises.

13 Claims, 4 Drawing Sheets

FIG. 2
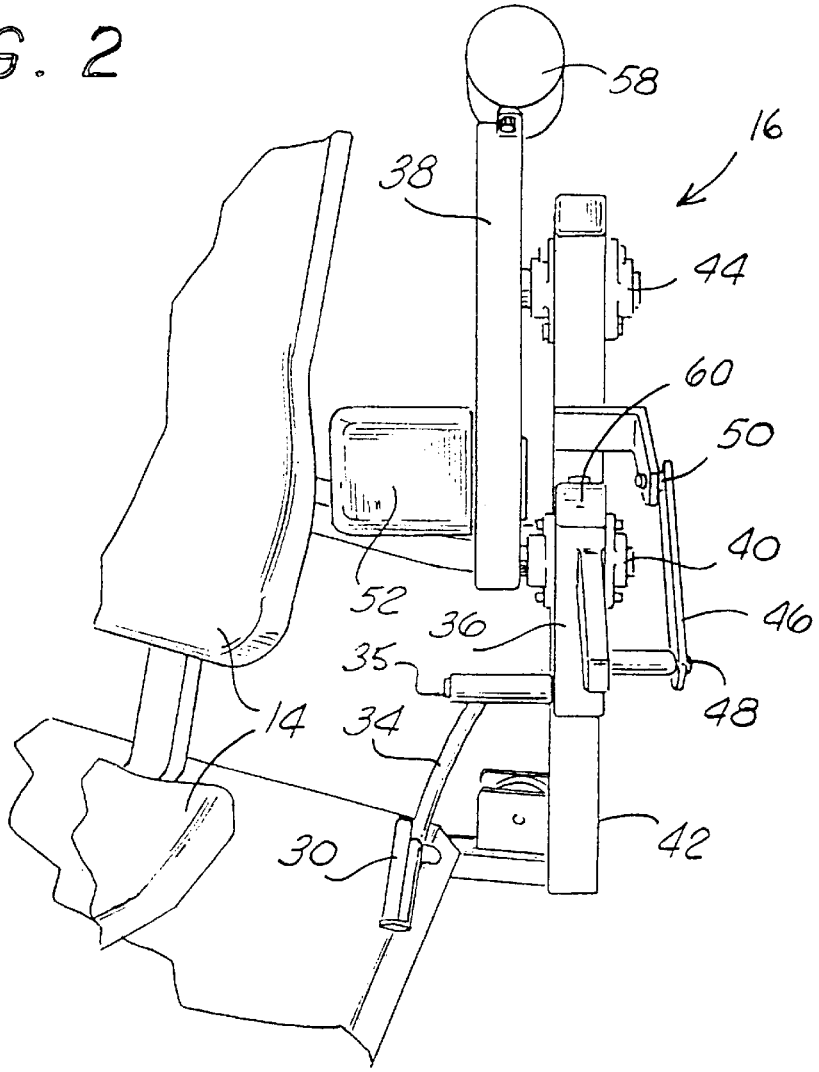
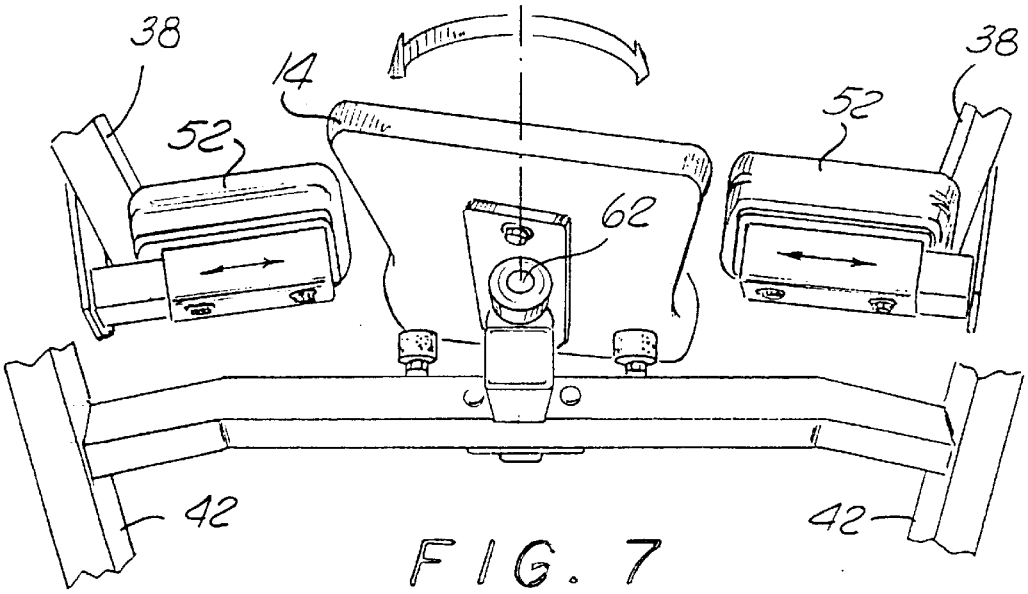
FIG. 7

ARTICULATED UPPER ARM EXERCISER

BACKGROUND OF THE INVENTION

1. FIELD OF THE INVENTION

This invention relates to the field of exercise equipment, and particularly to an apparatus for exercising the biceps and/or triceps muscles.

2. PRIOR ART

Weightlifting machines for exercising various muscle groups of the body are well-known. Such machines, particularly those intended for use by serious body builders, have become highly specialized. Some machines are designed to isolate a single muscle for exercise. For example, individual exercise machines are available for exercising only the biceps or triceps muscles of the arm. Prior exercise machines for exercising a single muscle typically have an exercise member that rotates about a single pivot.

Certain muscles of the human body are involved when limbs are moved at more than a single joint. For example, the biceps and triceps muscles are located between the elbow and shoulder joints. Typical prior art exercises for these muscle groups restrict movement of the arm to the elbow joint only. While movement at the elbow joint causes the greatest contraction of these muscles, the biceps muscle can also be exercised by locking the elbow joint and lifting the arm against resistance by rotation solely at the shoulder joint. Likewise, the triceps muscle can be exercised by locking the elbow joint and pushing down against resistance with rotation solely at the shoulder joint. However, the biceps and triceps muscles can be more completely and effectively exercised when both the elbow and shoulder joints are rotated with a large degree of rotation at the elbow joint and a proportionately smaller amount of rotation at the shoulder joint.

SUMMARY OF THE INVENTION

The present invention provides an exercise machine that is specially designed to exercise the biceps muscles, although the same design can be used to exercise the triceps muscles with only slight alteration. The exercise machine comprises a frame with a seat for the operator. A pair of exercise mechanisms are pivotally coupled to the frame for use by the operator in performing a biceps curl exercise. Each such mechanism includes an exercise arm coupled to the frame for rotation about two spaced-apart, generally horizontal axes. One axis is fixed with respect to the frame, while the second axis rotates about the first axis. A linkage member pivotally coupled to both the frame and the exercise arm connects the two axes of rotation. An additional linkage member is connected between the exercise arm and the frame.

Exercise resistance is provided by weights, although other sources of exercise resistance may be used. As the operator applies an exercise force to the exercise arms, the arms rotate about both the first and second axes, the relative movement about the two axes being coordinated by the linkage members.

BRIEF DESCRIPTION OF THE DRAWINGS

FIG. 2 is a front view of the left side exercise mechanism of the exercise apparatus of FIG. 1.

FIG. 7 illustrates adjustment features of the apparatus of FIG. 1.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
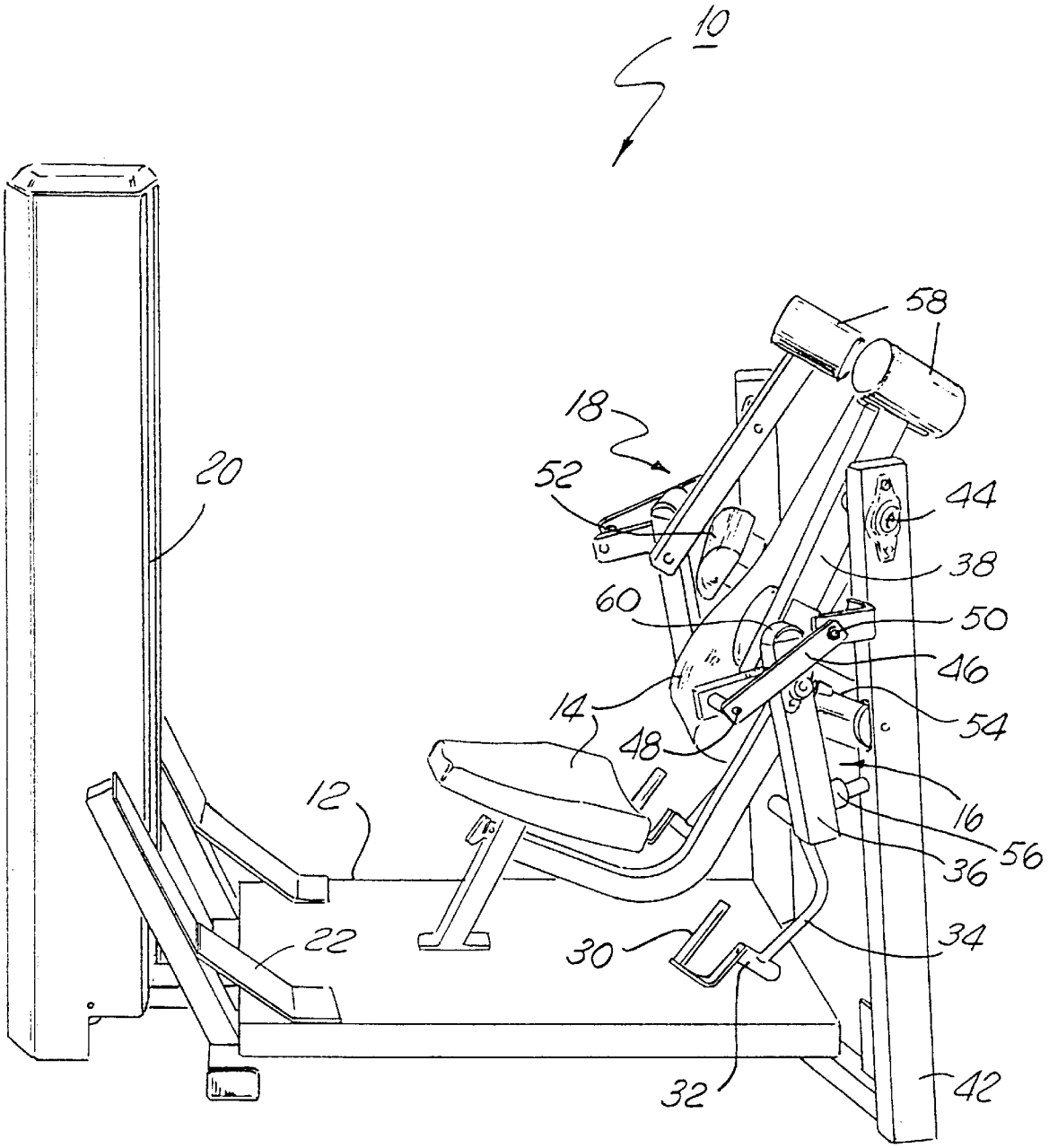
FIG. 1 is a side perspective view of an exercise apparatus according to the present invention.

The exercise apparatus of the present invention is illustrated generally in FIG. 1. Apparatus 10 comprises a frame 12 to which is attached a seat 14 and foot rests 22 for the operator. Also attached to the frame are a pair of exercise mechanisms 16 and 18 that are used by the operator in performing a biceps curl exercise. In the illustrated embodiment, exercise resistance is provided by a selectable weight stack 20; however, conventional weight plates could be loaded onto exercise mechanisms 16 and 18. Other sources of exercise resistance may also be utilized, including hydraulic, pneumatic, electromagnetic, friction, or even the operator's own body weight.

The two exercise mechanisms 16 and 18 operate independently. With additional reference to FIG. 2, details of the mechanism 16 for the operator's left arm will be described, it being understood that the mechanism 18 for the right arm is constructed in a corresponding manner. Handgrip 30 is pivotally coupled to extension member 34 at pivot 32 allowing the operator to select the most comfortable position of the wrist while performing the exercise. Extension member 34 is pivotally attached to L-shaped arm member 36 at pivot 35. This pivot accommodates the particular forearm length of the operator. Arm member 36 is pivotally coupled to arm member 38 at pivot 40. Arm member 38 is pivotally coupled to frame upright member 42 at pivot 44. Linkage member 46 interconnects arm member 36 at pivot 48 with frame upright 42 at pivot 50. Arm members 36 and 38, frame upright 42 and linkage member 46 thus define a "four-bar" arrangement.

Elbow rest 52 is attached to arm member 38 and projects inwardly towards seat 14. Exercise resistance selected at weight stack 20 is communicated to exercise mechanism 16 by cable 54, which is attached to arm member 36. Cable 54 is attached at its opposite end to a corresponding arm member of exercise unit 18. Cable 54 is guided over a floating pulley (not shown), which is attached by means of a belt (also not shown) to weight stack 20. Stop 56 is attached to frame upright 42 to engage arm member 36 and limit the rearward travel thereof. This allows exercise mechanisms 16 and 18 to be used independently. Counterweight 58 is attached to arm member 38 to dynamically balance exercise mechanism 16.

Figure 3:
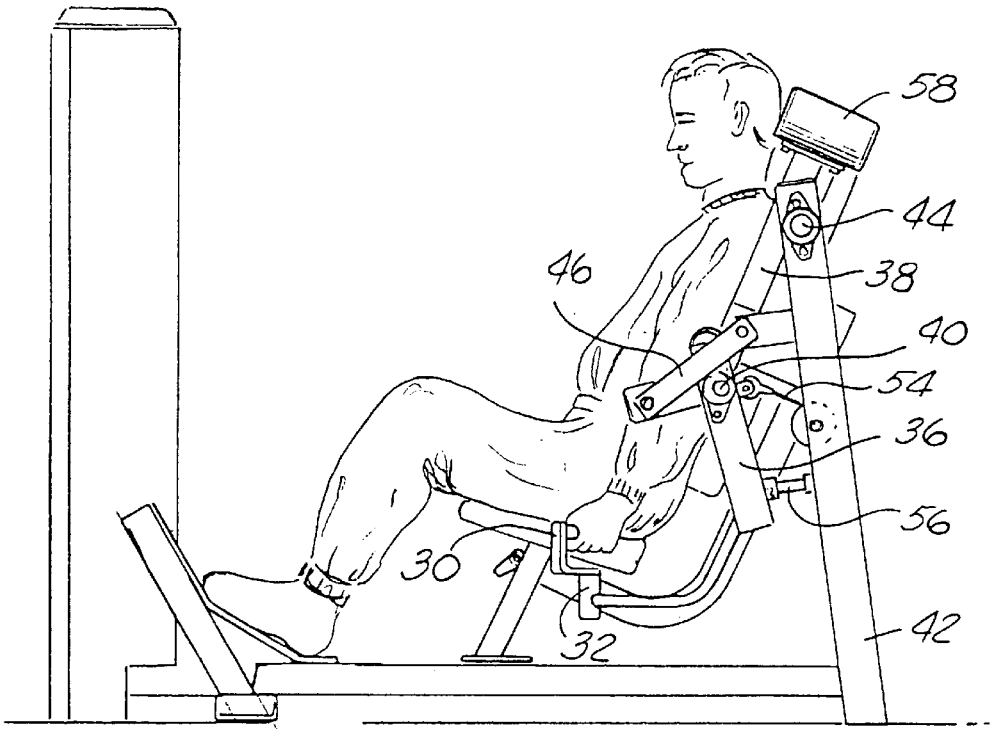
FIG. 3 illustrates the starting position of a biceps exercise performed on the apparatus of FIG. 1.

FIG. 3 illustrates the beginning position of a biceps curl exercise utilizing apparatus 10. The operator is seated in seat 14 and the operator's hands are placed on handgrips 30 of exercise mechanisms 16 and 18. The operator's elbows are placed on rests 52. It will be noted that the operator's arms are essentially straight at both the shoulder and elbow joints in the beginning position, although this will depend on the particular body structure of the operator.

Figure 4:
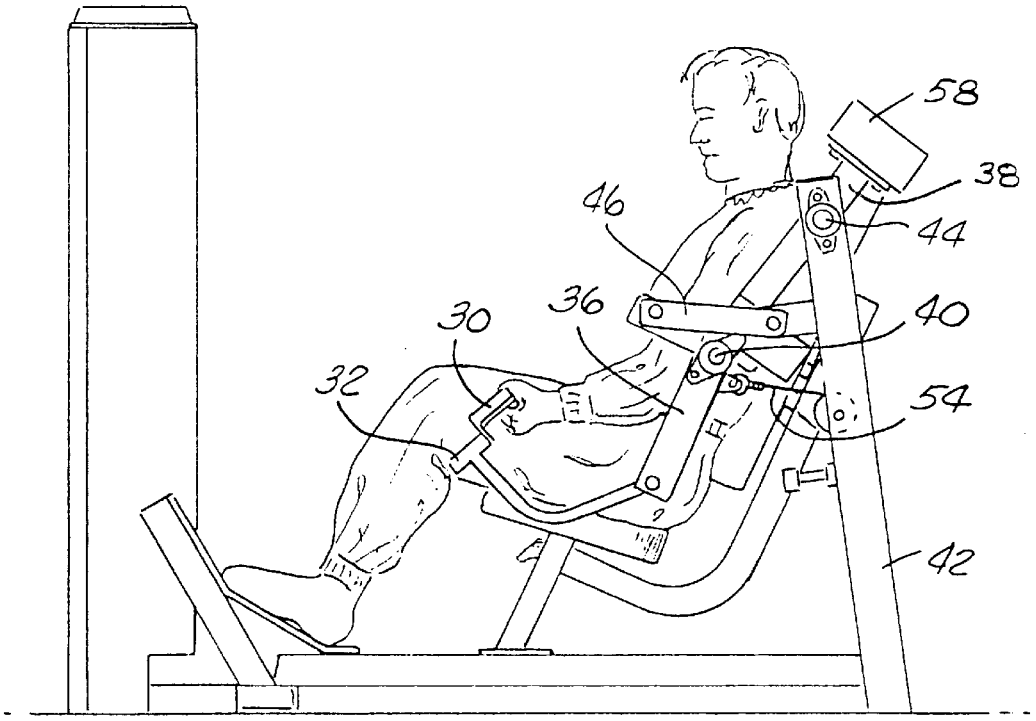
FIG. 4 illustrates a first intermediate position of a biceps exercise performed on the apparatus of FIG. 1.
Figure 5:
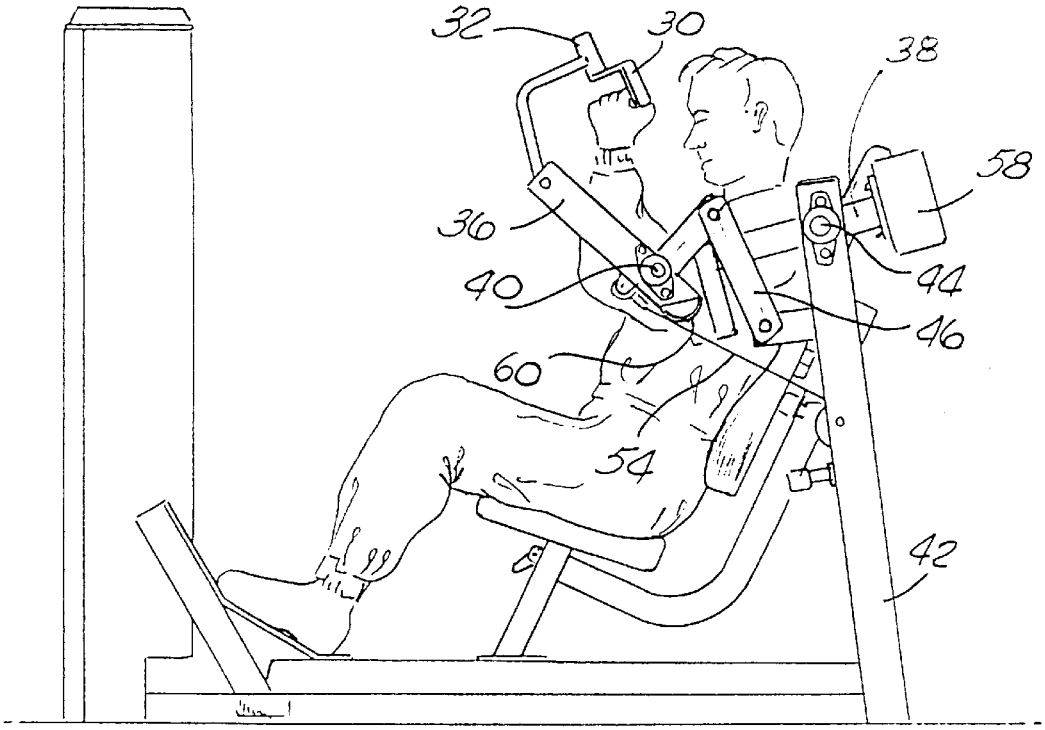
FIG. 5 illustrates a second intermediate position of a biceps exercise performed on the apparatus of FIG. 1.

Referring next to FIG. 4, the operator begins to lift exercise mechanism 16 by pulling on handle 30, with rotation principally about the elbow joint (corresponding to pivot 40). With reference now to FIG. 5, the operator continues the biceps curl exercise with further rotation of the elbow joint and a lesser degree of rotation at the shoulder joint. This is apparent by noting the relative rotations of arm member 36 about pivot 40 and arm member 38 about pivot 44.

Figure 6:
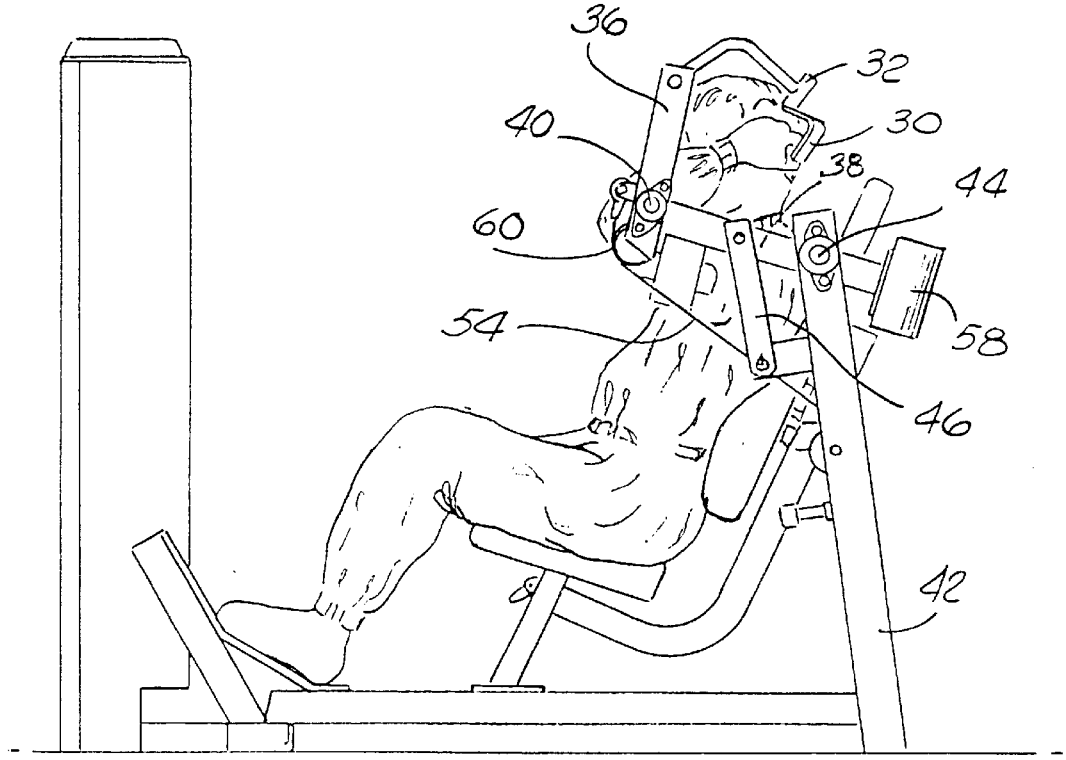
FIG. 6 illustrates the ending position of a biceps exercise performed on the apparatus of FIG. 1.

FIG. 6 illustrates the ending position of the exercise in which handgrip 30 has been brought over the operator's shoulder with maximum contraction of the biceps muscle. During the course of performing the exercise stroke, there has approximately 160° of rotation at the operator's elbow joint and nearly 90° of rotation at the operator's shoulder joint.

FIG. 7 illustrates how the backrest of seat 14 is pivotally attached to frame 12 on pivot 62. This allows the operator to assume a comfortable operating posture with respect to either of exercise mechanisms 16 and 18, which, as can be seen in this view, are canted slightly outwardly from the center line of the apparatus. Arm rests 52 are each slidably adjustable in a lateral direction on respective arm members 38 to further accommodate the size of the individual operator.

Although the present invention has been described in terms of a specific embodiment using a four-bar linkage mechanism to coordinate the relative movement of the exercise arm members 36 and 38 about the axes of rotations defined by pivots 40 and 44, other means may be employed.

The above-described embodiment of the present invention is specially designed for performing a biceps curl exercise. It will be appreciated that the same machine may be adapted to exercise the triceps muscles by providing resistance to downward motion of the exercise mechanisms. For a triceps exercise, the starting position would be essentially as shown in FIG. 6 and the ending position would be essentially as shown in FIG. 3. The invention may also be utilized for exercising other muscle groups of the body. For example, the invention may be embodied in a similarly constructed machine for performing leg extension and/or leg curl exercises.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An apparatus for exercising the arms of a user comprising:

a frame;

a support attached to the frame for supporting a user in a seated posture;

an exercise arm having a first segment pivotally coupled to the frame for movement about a first generally horizontal axis and a second segment pivotally coupled to the first segment for movement about a second axis parallel to the first axis, said first segment including an elbow rest and said second segment including a hand grip;

a linkage member pivotally coupled at a first end to the frame and pivotally coupled at a second end to the second segment of the exercise arm, said linkage member coupled to the frame and exercise arm so that incremental angular movement of the first segment of the exercise arm about the first axis causes relatively greater angular movement of the second segment of the exercise arm about the second axis;

means for supplying exercise resistance; and resistance communication means coupled to the means for supplying exercise resistance and to the second segment of the exercise arm to resist rotation about the first and second axes.

2. The apparatus of claim 1 further comprising a counterweight coupled to the first segment of the exercise arm.

3. The apparatus of claim 1 wherein the means for supplying exercise resistance comprises a weight stack.

4. The apparatus of claim 1 wherein the exercise arm is one of a pair of exercise arms symmetrically disposed with respect to a longitudinal axis of the apparatus.

5. The apparatus of claim 4 wherein each of the pair of exercise arms is independently movable.

6. The apparatus of claim 4 wherein the first and second axes of respective exercise arms are at an oblique angle with respect to the longitudinal axis.

7. The apparatus of claim 6 wherein the support includes a backrest pivotally mounted on the frame for rotation about a generally vertical axis.

8. An exercise apparatus comprising:

a frame defining a longitudinal axis of the apparatus;

a support attached to the frame for supporting a user in a seated posture;

a pair of exercise arms, each disposed at an oblique angle with respect to the longitudinal axis and each having a first segment pivotally coupled to the frame for movement about a first generally horizontal axis and a second segment pivotally coupled to the first segment for movement about a second axis parallel to the first axis, said second segment including a hand grip;

a linkage member for each exercise arm pivotally coupled at a first end to the frame and pivotally coupled at a second end to the second segment of the respective exercise arm, said linkage member coupled to the frame and exercise arm so that incremental angular movement of the first segment of the exercise arm about the first axis causes relatively greater angular movement of the second segment of the exercise arm about the second axis;

means for supplying exercise resistance; and resistance communication means coupled to the means for supplying exercise resistance and to the second segment of each exercise arm to resist rotation about the first and second axes.

9. The apparatus of claim 8 wherein the support includes a backrest pivotally mounted on the frame for rotation about a generally vertical axis.

10. The apparatus of claim 8 wherein each of the pair of exercise arms is independently movable.

11. The apparatus of claim 8 further comprising a counterweight coupled to the first segment of each exercise arm.

12. The apparatus of claim 8 wherein the means for supplying exercise resistance comprises a weight stack.

13. The apparatus of claim 8 further comprising an elbow rest on the first segment of each exercise arm.

* * * * *